United States Patent [19]

Davis

[11] 4,074,863

[45] Feb. 21, 1978

[54] PORTABLE OPEN FIREPLACE BLOWING APPLIANCE

[76] Inventor: Mary Evelyn Davis, 12319 Charles Road, Silver Spring, Md. 20906

[21] Appl. No.: 551,546

[22] Filed: Feb. 21, 1975

[51] Int. Cl.[2] ..... F23L 9/06

[52] U.S. Cl. ..... 239/589; 126/25 B; 110/182.5

[58] Field of Search ..... 431/252; 110/75 B, 1 F, 110/182, 182.5; 126/15 R, 15 A, 25 B; 239/589, 525

[56] References Cited

U.S. PATENT DOCUMENTS

| | | | |
|---|---|---|---|
| 104,078 | 6/1870 | Street | 431/252 |
| 152,942 | 7/1874 | Eames | 75/45 |
| 227,136 | 5/1880 | Stuntz | 239/398 |
| 645,399 | 3/1900 | King | 131/187 |
| 739,221 | 9/1903 | Reinlein | 431/343 |
| 948,875 | 2/1910 | Davis | 431/252 |
| 1,867,526 | 7/1932 | Anderson et al. | 239/589 |
| 3,850,374 | 11/1974 | Snoddy | 239/571 |

*Primary Examiner*—Carroll B. Dority, Jr.

[57] ABSTRACT

A portable open fireplace blowing appliance comprising a tubular body portion of a substantial length and uniform diameter formed of heat resistant material having a cap secured at one end, the cap having a centrally located opening between 1/32 of an inch to 3/32 of an inch through which a jet of air can be blown by placing the mouth at the other end, and a tapered mouth end of said body portion through which the user blows. By directing the blowing appliance to embers in a fireplace, the jet stream emerging from the cap opening causes the fireplace wood or charcoal to kindle and burst into flames.

1 Claim, 8 Drawing Figures

PORTABLE OPEN FIREPLACE BLOWING APPLIANCE

BACKGROUND OF THE INVENTION

1. Field of the Invention

The invention is in the field of blowers for fireplaces, the devices being used therefore, being of an ornamental character and adapted to be polished to a high sheen to thereby blend in with other fireplace appliances such as polished brass implements used to manipulate fireplace logs used in open fireplaces and the like.

2. Description of the Prior Art

Waldmeier, U.S. Pat. No. 1,282,997, shows a blower attachment in a blow pipe torch used by a dentist or jeweler, and this structure serves to direct a flame used to perform a technical operation like soldering or welding. Applicant is familiar with glass blowing pipes used by highly skilled workmen for blowing vases and the like. These pipes are open at the bottom end to permit a lateral uniform diffusion of air in shaping the hot glass in molten form.

A blow pipe is shown in Stuntz, U.S. Pat. No. 227,136, which shows a uniform wide top and longitudinal bore and a jet C which is at a side as compared with the blower of the present invention which locates an air jet at the center of the cap.

Eames, U.S. Pat. No. 152,942, shows a narrow tip, narrow mouth, and wider bore tube for blowing air into a charcoal iron mixture.

Seltzer, U.S. Pat. No. 629,798, is cited for the teaching of a screw threaded cap having a narrow opening and is of interest.

SUMMARY OF THE INVENTION

The invention relates to a portable open fireplace blowing appliance comprising a tubular body portion of substantial length between 20 inches and about 80 inches and of uniform diameter formed of heat resistant materials preferably copper, stainless steel, brass or the like having a cap secured at one end, the cap having a centrally located opening between 1/32 of an inch to 3/32 of an inch through which a jet of air can be blown by placing the mouth at the other end, and a tapered mouth end of said body portion through which a person blows air through the appliance.

In contrast to pokers and other fireplace tools used to shift the burning logs in relation to fresh logs which are placed in the open fireplace, the present blowing appliance or blower, as it is hereinafter called, does not touch the burning embers but serves only to direct a jet of air to kindle the embers and aid burning, in much the same manner as bellows are used but with greater safety.

OBJECTS OF THE INVENTION

An object of the invention is to provide an ornamental blower in the form of a unitary tool having a cap and jet opening at one end and a tapered mouthpiece at the other end, the body portion of the blower tube being of relatively large diameter in comparison to the opening for the jet stream of air at the cap end, the ratio of the inner diameter of the tubular body portion of the blower being from 20 times as great down to 6 times as great as the diameter of the jet opening.

A further object of the invention is to provide a jet blower device of the type described constructed of heat resistant material, e.g., metal or heat resistant plastic such as Lexan (polycarbonate), but is preferably a corrosion resistant and easily polished material such as copper, brass or the like.

A still further object of the invention is to provide a blower device having a riveted cap at one end and a riveted tapered mouthpiece connector fastened to the other end with a reduced opening.

Another object of the invention is to provide an ornamental blowing appliance having a strap near the mouth end to aid in moving the blowing appliance about and directing the jet stream of air from the cap end.

These, and other objects and advantages of the present invention, will become apparent from the following detailed disclosure.

BRIEF DESCRIPTION OF THE DRAWINGS

Other features and aspects of the present invention will emerge more fully from the following specifications given here with reference to the attached drawings in which.

DESCRIPTION OF THE PREFERRED EMBODIMENTS

Figures 1, 2, 3, 4, 5, 6, 7, 8:
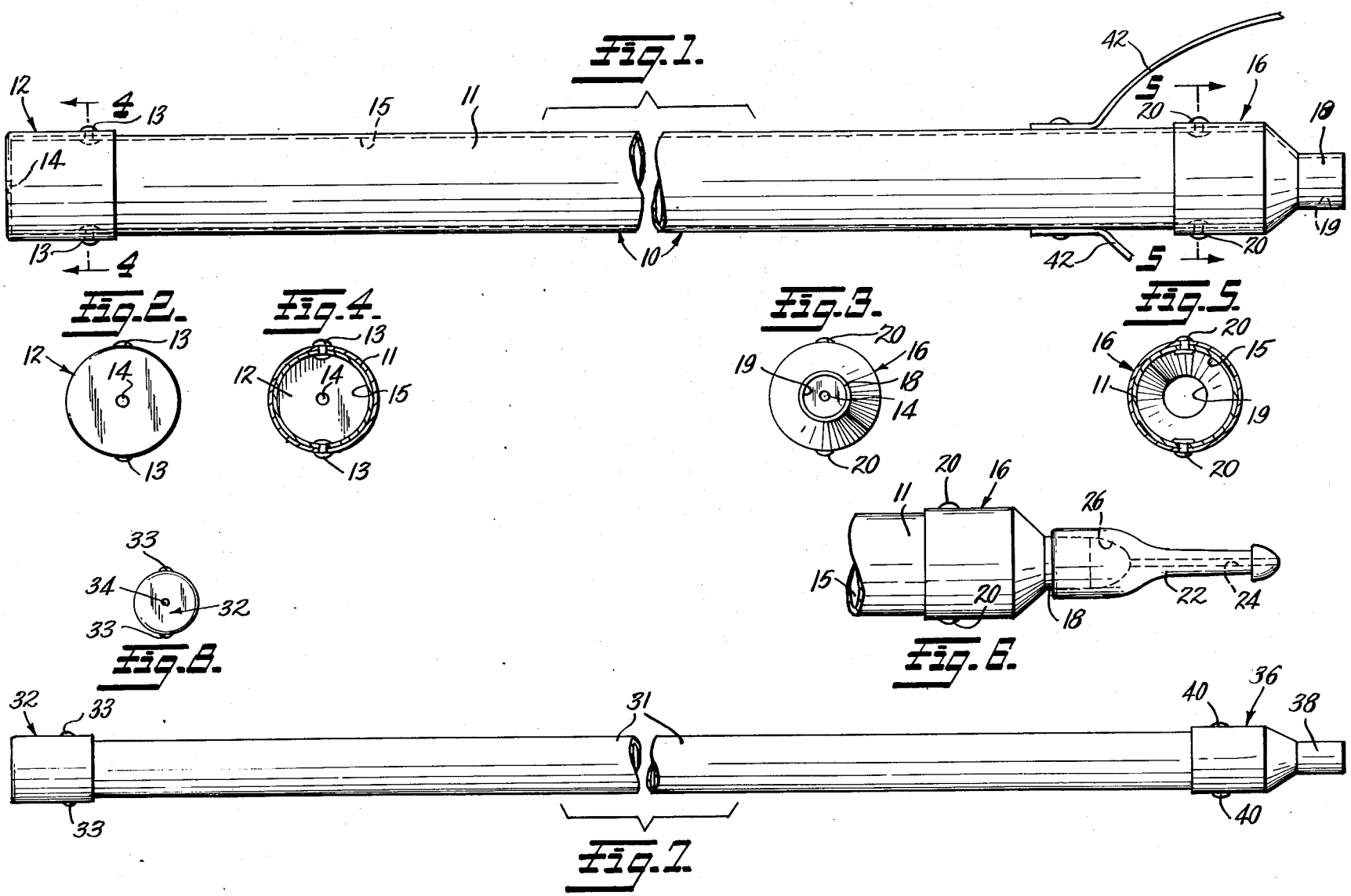
FIG. 1 is a fragmentary elevational view of the blower of the present invention.
FIG. 2 is an end view as seen from the left of FIG. 1.
FIG. 3 is an end view as seen from the right of FIG. 1.
FIG. 4 is a vertical sectional view, taken on the line 4—4 of FIG. 1.
FIG. 5 is a vertical sectional view, taken on the line 5—5 of FIG. 1.
FIG. 6 is a fragmentary elevational view of the right-hand portion of a blower illustrating a modified form of the mouthpiece.
FIG. 7 is a fragmentary elevational view of a modification of the blower; and, FIG. 8 is a left end view of the device of FIG. 7.

Referring to FIG. 1 of the drawings herein, there is shown a model of a preferred form of the portable open fireplace blower 10 of the invention, the blower 10 comprising body portion 11, which in the 24 inch length has an inner diameter of $\frac{7}{8}$ inch and is formed of polished copper. One end of the body portion 11 is capped with end cap 12 riveted by means of rivets 13, the end cap 12 having the same inner diameter as the body portion 11 ($\frac{7}{8}$ inch) and being provided with central opening or orifice 14 having a diameter of 1/16 inch. The ratio between the inner diameter of the cap 12 to the inner diameter of jet orifice 14 is 28/32 to 2/32 of an inch or about 14 to 1 (see FIG. 2). At the mouth end of the body portion 11, there is riveted the mouthpiece connector 16 formed with tapered and reduced portion 18. The inner diameter of the passage 19 of the mouthpiece connector 16, is $\frac{1}{2}$ inch, and this connector may, if desired, be formed of plastic or of the same metal.

The rivets 20 as shown in FIGS. 1 and 5 secure the mouthpiece connector 16 tightly to the body portion 11. Although the reduced portion 18 is shown in FIG. 1 to be formed of the same metal material as is the body portion 11, and this metal being copper in the preferred example, it is possible to fit onto the reduced portion 18 a plastic mouthpiece 22 as shown in FIG. 6, such as is used in cigars. The embodiment in FIG. 6 utilizes the same metal mouthpiece connector member 16 riveted by rivets 20 to the body portion 11 and mouthpiece 22 is fitted over the reduced portion 18. The passage 24 which communicates with the wide opening 26 extends to the tip of the plastic mouthpiece then permits the same blower to be used by several persons each having his own plastic mouthpiece 22 of the construction shown in FIG. 6. The modifications shown in FIG. 7 is a view of a very long blower having a body portion 31 which is about 48 inches long, end cap 32 with opening 34 which is 3/32 of an inch long and mouthpiece connector 36 having reduced portion 38 similar to that in FIG. 1.

The FIG. 1 embodiment has strap 42 mounted adjacent the mouthpiece but below the rivets 20 and as shown the entire loop of strap 42 may vary in accordance with the adjustment preferred by the user. It is simpler to pick up the blower 10 or 31 by the strap of FIG. 1, but is not an essential part of the invention to the strap attached to the body portion 11 or 31.

The riveted construction of the caps 12 and 32 and of the mouthpieces 16 and 31 in FIGS. 1 and 7, respectively, provide very significant manufacturing advantages in economy of fabrication and sturdiness of construction. Soldered joints could melt when exposed to the heat of the fireplace. Adhesive joints could cause discoloration of the heat resistant metal or plastic material of the blower 10 or 31 and could deteriorate.

An important advantage of the blower of the present invention lies in the ability of the material to be electroplated with precious metals and gives a high polish. Decorative patterns can be applied by stencil, electroplating, inlaying, enameling, or the like. The blower may be goldplated or silverplated. Anodized aluminum available in many different colors can be used.

It is evident from the foregoing description that the various forms of the invention include decorated, painted, anodized, inlaid and filigreed blowing appliances which can add to the aesthetic enjoyment of the persons who use open fireplaces as well as to help these persons keep the fire going with fresh fuel despite a condition where only a few embers are glowing.

Obviously, those paints and decorative coatings will be used as are heat resistant materials, but it is not intended to use the present device as a poker, since it will blacken and loose its aesthetic appearance.

In the foregoing description of the preferred embodiments, dimensions are critical, not only the diameter dimensions of the body portion and orifice or opening in the end cap, but also the length dimension. It has been found that with small indoor fireplaces the modification of the blower with body portion 31 of 24 inches in length will be adapted for practically all of the indoor fireplaces now in use whereas the very large open air fireplaces or those fireplaces used in large meeting rooms will be best served with a long blower with a body portion of 48 inches in length. In this way of adjusting the length, the user can be sufficiently far away from the hot coals in the fireplace to keep a safe distance and yet be able to manipulate the blower and direct the stream accurately at the glowing embers without touching the cap end.

What is claimed is:

1. A portable open fireplace blower comprising:

an open rigid straight line tubular body portion of substantial length and uniform diameter formed of heat resistant metal;

an end cap rivetedly secured at one end of said body portion having in a planar end section a centrally located orifice between 1/32 of an inch and 3/32 of an inch through which a jet of air is blown after placing the mouth of the user at the other end to blow, said cap having the same inside diameter as the outside diameter of said tubular body portion and the inside diameter of said tubular body being at least 6 times the diameter of said centrally located orifice;

a mouthpiece connector having an end opening whose inner diameter is substantially the same as that of said tubular body portion and is non-adhesively secured at the end of said body portion opposite said cap and orifice;

said mouthpiece connector including a tapered portion extending from the end of the tubular body and an end portion of substantially smaller diameter than said tubular body attached to the tapered portion; a mouthpiece mounted on the end portion of said connector;

and said centrally located orifice being on the common central longitudinal axis of said body portion and said mouthpiece whereby a long column of air in said body portion under mouth pressure of the user exits as a fine single air jet along said common axis to permit accurate impingement of the air on a burning coal.

* * * * *